US006568001B2

(12) United States Patent
Walsh

(10) Patent No.: US 6,568,001 B2
(45) Date of Patent: May 27, 2003

(54) LOFT BED ASSEMBLY WITH MULTIPLE STORAGE COMPARTMENTS

(76) Inventor: Brendan Walsh, 417 E. 236th St., Bronx, NY (US) 10470

( * ) Notice: Subject to any disclaimer, the term of this patent is extended or adjusted under 35 U.S.C. 154(b) by 5 days.

(21) Appl. No.: 09/975,820

(22) Filed: Oct. 12, 2001

(65) Prior Publication Data

US 2003/0070224 A1 Apr. 17, 2003

(51) Int. Cl.[7] ..... A47C 17/00; A47B 83/00
(52) U.S. Cl. ..... 5/2.1; 5/9.1; 5/308
(58) Field of Search ..... 5/1, 9.1, 2.1, 308, 5/507.1

(56) References Cited

U.S. PATENT DOCUMENTS 3,011,180 A * 12/1961 Majeski ..... 5/9.1
3,325,233 A * 6/1967 Oppenhuizen et al. ..... 312/195
4,109,328 A * 8/1978 Mason ..... 5/2.1
4,139,077 A * 2/1979 Pena, Jr. ..... 182/35
4,253,204 A * 3/1981 Tasaka ..... 5/2.1
4,312,086 A * 1/1982 Bianco ..... 5/2.1
D276,386 S 11/1984 Shaw
D279,339 S 6/1985 Testa
D325,825 S 5/1992 Bell
D331,841 S 12/1992 Pitner
D346,708 S 5/1994 Baer
5,540,491 A * 7/1996 Wu ..... 312/237
D400,025 S 10/1998 Lightner
D412,070 S 7/1999 Nesbit
6,167,579 B1 * 1/2001 Kopish ..... 5/2.1

* cited by examiner

*Primary Examiner*—Michael Trettel

(57) ABSTRACT

A space-conscious, functional design for a loft bed. The design serves to optimize space by incorporating multi-functional features, such as drawers, closet space, or cabinet space, within the assembly for the bed itself. Specifically, a plurality of steps are substantially parallel to the length of the bed, and lead upwardly toward the foot of the bed for easy access to same. Such steps incorporate the aforementioned storage space, with access to the drawers or closets from a side position. As such, the unique assembly allows for a desk, computer work station, bar, or additional wide storage space below the bed and behind the steps, adding to the overall versatility of the assembly. Finally, in the preferred mode the unit is modular in nature and may be assembled and rearranged based upon user preference.

11 Claims, 2 Drawing Sheets

LOFT BED ASSEMBLY WITH MULTIPLE STORAGE COMPARTMENTS

BACKGROUND OF THE INVENTION

1. Field of the Invention

The present invention is a space-conscious design for a loft bed. The design serves to optimize space by incorporating multi-functional features, such as drawers, closet space, or cabinet space, within the assembly for the bed itself. Specifically, a plurality of steps are substantially parallel to the length of the bed, and lead upwardly toward the foot of the bed for easy access to same. Such steps incorporate the aforementioned storage space, with access to the drawers or closets from a side position. As such, the unique assembly allows for a desk, computer work station, bar, or additional wide storage space below the bed and behind the steps, adding to the overall versatility of the assembly. Finally, in the preferred mode the unit is modular in nature and may be assembled and rearranged based upon user preference.

2. Description of the Prior Art

Numerous innovations for loft bed assemblies have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the present invention and the prior art.

Utility Patents

1. U.S. Pat. No. 4,109,328, invented by Mason, "Modular Furniture System"

In the patent to Mason, a modular furniture system is disclosed which consists of functional modules that can be oriented, stacked and interlocked to create different furniture assemblies. The modules include identical rectangular enclosures, one of which contains drawers and another a cupboard and retractable writing surface. The enclosures can be stacked one on top of the other with a portion of the uppermost enclosure supporting one end of an upper bunk bed module. Another support means supports the other end of the bunk bed. An apparatus is also disclosed for interlocking the stackable enclosures and the upper bunk bed end to the uppermost enclosure. A removable cover is provided for the exposed portion of the uppermost enclosure adjacent the end of the bunk bed. By varying the width of the removable cover, a shelf of variable area can be provided. One end of a lower bunk bed module can be positioned within the enclosure formed by the upper bed and its two end supports. In addition, the bunk beds have removable side boards and removable head boards attachable to either side or either end of the bunk beds. The modules can be arranged so that the upper bunk bed can be longitudinally disposed along any wall of a room with either support structure adjacent any corner and the length of the combined bunk bed and end support structures can be varied according to the available space.

Design Patents

2. U.S. Pat. No. D400,025, invented by Lightner, "Combined Loft Bed, Desk, and Filing Cabinets"

In the patent to Lightner an ornamental design for combined loft bed, desk and filing cabinets is shown and described.

3. U.S. Pat. No. D412,070, invented by Nesbit, entitled "Loft Bed System"

In the patent to Nesbit an ornamental design for a loft bed system is shown and described.

4. U.S. Pat. No. D346,708, invented by Baer, entitled "Convertible Child's Bed"

In the patent to Baer an ornamental design for a convertible child's bed is shown and described.

5. U.S. Pat. No. D279,339, invented by Testa, entitled "Combined Loft Bed and Cabinet Assembly or Similar Article"

In the patent to Testa an ornamental design for a combined loft bed and cabinet assembly or similar article is shown and described.

6. U.S. Pat. No. D342,393, invented by Cephas, entitled "Combined Under Bed Storage and Frame Unit"

In the patent to Cephas an ornamental design for a combined under bed storage and frame unit is shown and described.

7. U.S. Pat. No. D276,386, invented by Shaw, entitled "Loft Bed"

In the patent to Shaw an ornamental design for a loft bed is shown and described.

8. U.S. Pat. No. D325,825, invented by Bell, entitled "Combined Bed and Storage Unit"

In the patent to Bell an ornamental design for a combined bed and storage unit is shown and described.

9. U.S. Pat. No. D331,841, invented by Pitner, entitled "Combined Bed, Storage Unit and Platform"

In the patent to Pitner an ornamental design for a combined bed, storage unit and platform is shown and described.

As outlined above, the prior art patents that relate to loft-style beds largely entail elements such as: loft beds still using traditional ladders to access the beds; loft beds relying on substantially square and solid assemblies; and beds that entail decorative features, particularly for children.

In contrast to the above, the present invention illustrates a unique assembly for a loft bed, utilizing a plurality of steps rather than a traditional ladder. Such steps conveniently allow for drawers, cabinets, or even a closet to be included within, saving tremendous space in the room or area. Moreover, the assembly allows for a work station or larger storage area immediately below the bed, once again conserving space in an aesthetically pleasing manner.

SUMMARY OF THE INVENTION

As noted, the present invention is a space-conscious design for a loft bed. The design serves to optimize space by incorporating multi-functional features, such as drawers, closet space, or cabinet space, within the assembly for the bed itself. Specifically, a plurality of steps are substantially parallel to the length of the bed, and lead upwardly toward the foot of the bed for easy access to same. Such steps incorporate the aforementioned storage space, with access to the drawers or closets from a side position. As such, the unique assembly allows for a desk, computer work station, bar, or additional wide storage space below the bed and behind the steps, adding to the overall versatility of the assembly. Finally, in the preferred mode the unit is modular in nature and may be assembled and rearranged based upon user preference.

In light of the foregoing, it is generally an object of the present invention to provide an assembly that if functional and highly effective for its intended purposes.

It is a further object of the invention to provide an assembly that optimizes space and conserves significant amounts of space for other usage.

It is a further object of the invention to provide an assembly that is safe in nature, complying with all relevant regulations and guidelines.

It is an object of the invention to provide an assembly that may utilize a handrail, for additional safety and stability.

It is a further object of the present invention to provide an assembly that is relatively inexpensive to manufacture, produce, and distribute.

It is a further object of the present invention to provide an assembly that may be manufactured in a variety of sizes.

In addition, it is an object of the present invention to provide an assembly that is modular in nature, rendering the same convenient to assembly and disassemble.

It is an object of the present invention to provide an assembly that utilizes laminate or solid wood finishes.

It is an object of the present invention to provide an assembly that may be decorative in nature, such as by bearing a sculpted design, or by bearing graphics and indicia thereon.

It is also an object of the present invention to provide an assembly that incorporates multifunctional features therein, such as drawers, cabinets, closet space and other recessed compartments, built directly into the assembly.

It is particularly an object of the present invention to provide an assembly that utilizes a series of steps that double as drawers and storage compartments.

It is also an object of the present invention to provide an assembly that is pre-wired for a variety of purposes, including general power inlet, telephone lines, cable lines, high speed Internet lines, speaker wires, track lighting, and a host of other items.

It is particularly an object of the present invention to provide an assembly that allows for a computer workstation to be used therewith, such as by including a desktop, pull-out monitor tray, and sufficient space for a mouse, keyboard and other peripheral devices.

Finally, it is an object of the present invention to provide alternate embodiments of the device, wherein the invention is constructed of different materials, according to manufacturer and user needs.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

DETAILED DESCRIPTION OF THE PREFERRED EMBODIMENT

Figure 1:
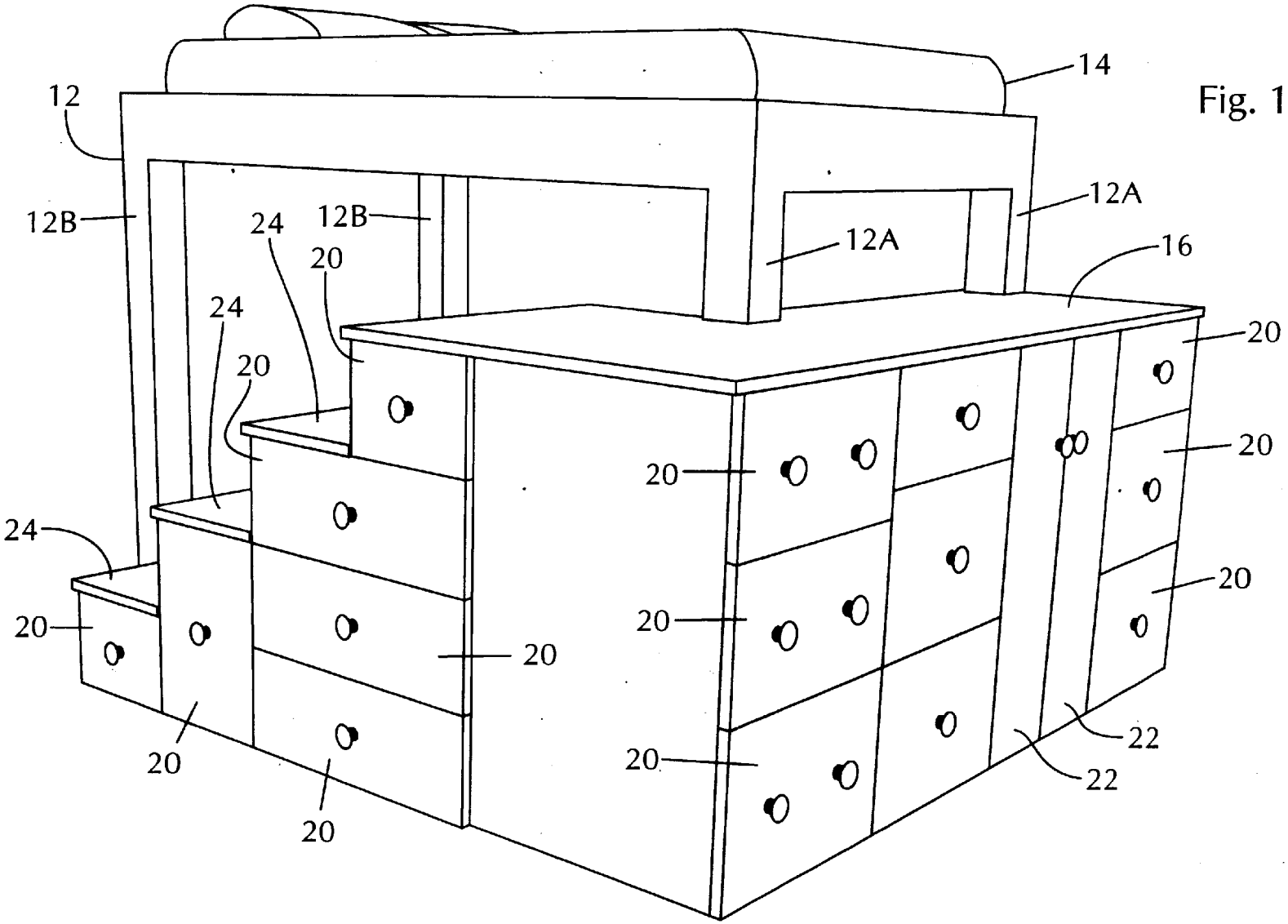
FIG. 1 is a three-quarter perspective view of the loft bed assembly with multiple storage compartments, illustrating steps leading to the bed containing drawers therein, and multiple storage compartments at the front section thereof.
Figure 2:
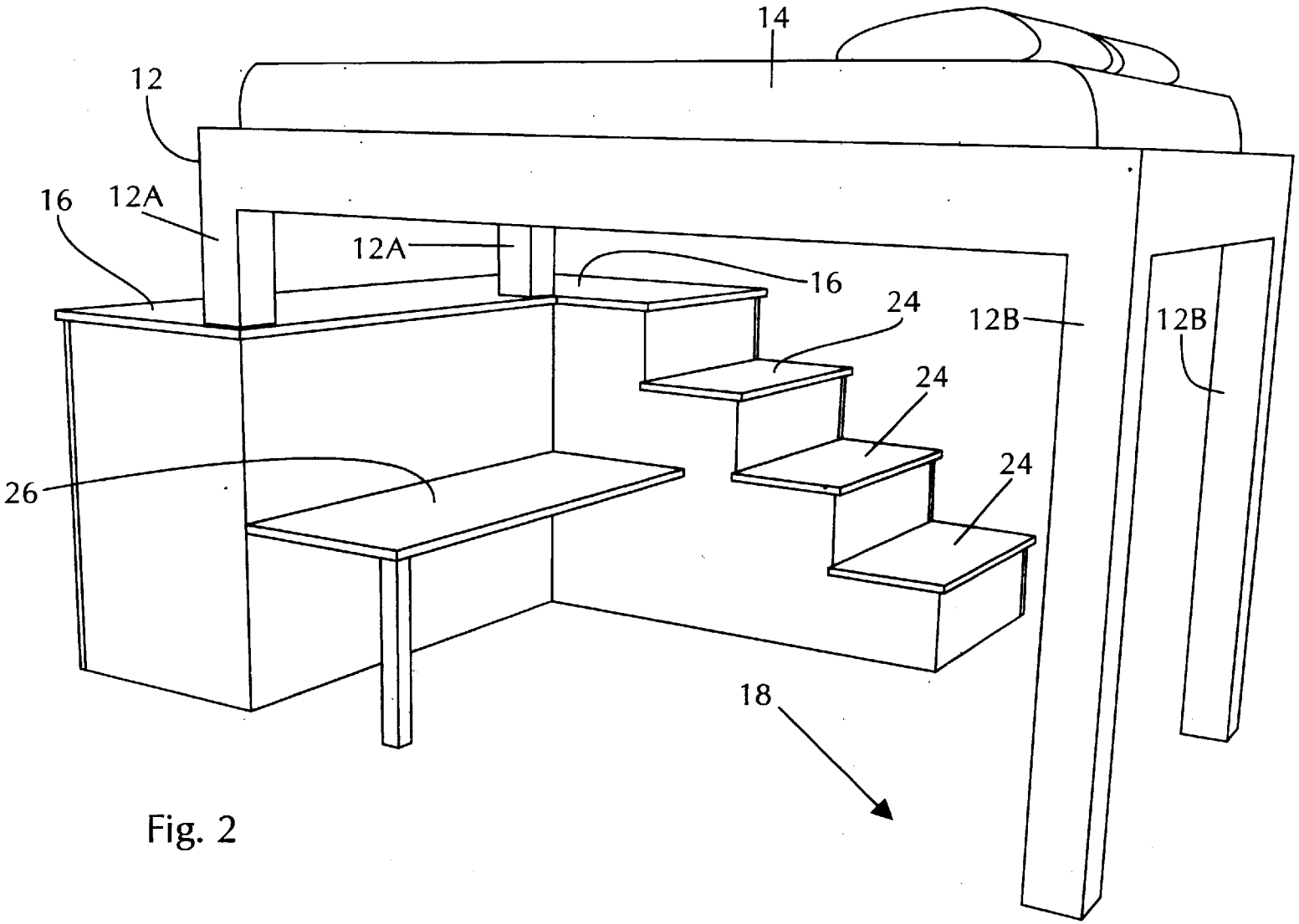
FIG. 2 is a three-quarter perspective view of the loft bed assembly with multiple storage compartments, illustrating steps leading to the bed containing drawers therein, and desk assembly located beneath the bed.

The following description relates to FIG. 1, which is a three-quarter perspective view of the loft bed assembly with multiple storage compartments, illustrating steps leading to the bed containing drawers therein, and multiple storage compartments at the front section thereof, and FIG. 2, which is a three-quarter perspective view of the loft bed assembly with multiple storage compartments, illustrating steps leading to the bed containing drawers therein, and desk assembly located beneath the bed.

The assembly includes a bed frame (12), bed frame shorter legs (12A), bed frame longer legs (12B), mattress (14), dresser component (16), which the shorter bed frame legs sit on, floor (18), that the longer bed frame legs sit on, a plurality of drawers (20), multiple cabinet-like storage areas (22), a series of steps (24), and a table or desk-like surface (26).

The loft bed assembly with multiple storage compartments comprises a bed frame (12), which comprises two short legs (12A) extending downwardly from a first end of the bed frame (12), and two long legs (12B) extending downwardly from a second end of the bed frame (12). Such function to raise the bed frame (12) to a substantially high plane. The bed frame (12) further comprises a mattress (14) thereon.

A generally rectangular dresser component (16) is removably attached to a section of steps (24), which is positioned generally perpendicular thereto, forming a generally "L" shaped configuration. A bottom surfaice of the dresser component (16) rests upon a floor surface (18), and a bottom portion of the section of steps (24) similarly rests upon the floor surface (18).

The dresser component (16) comprises a plurality of drawers (20), and cabinet and closet compartments (22) recessed therein, which extending outwardly from an exterior surface of the dresser component (16).

Likewise, the section of steps (24) comprises a plurality of drawers (20), and cabinet and closet compartments (22) recessed therein, which extending outwardly from an exterior surface of the section of steps (24).

Bottom portions of the short legs (12A) of the bed frame (12) come in contact with and rest upon an upper surface of the dresser component (16). This upper surface is large and rectangular in configuration, much in the mariner of a traditional dresser surface for the containment or display of a great variety of items. The bottom surfaces of the long legs (12B) come in contact with and rest upon floor surface (18).

Next, a desk top surface (26) is generally parallel to the floor surface (18) and extends outwardly from an interior surface of the dresser component. This functions to provide a workstation thereon, as will be discussed at greater length herein Importantly, the assembly is modular in nature, functioning to allow a user to easily assemble and disassembly the assembly.

In addition, for the utmost in versatility, the above-mentioned mattress is of a size is selected from the group consisting of king, queen, twin, and single.

The assembly of the present invention utilizes an "L" shape, creating significant floor space due to the unique loft bed configuration. Thus, space created by the assembly is used in a manner selected from the group consisting of a computer workstation area, den area, additional storage space area. Such is ideal for those living in apartments or small areas, and is also highly effective for those who simply seek to maximize available space.

The assembly may further include a chair to be utilized with the desktop surface, in which case the chair may be of a similar decor and style as the assembly itself.

In the preferred mode, the assembly utilizes a total of four steps, but a higher or lower number of such stairs may be utilized as needed.

Regarding decorative features, the assembly is of a finish selected from the group consisting of laminates and a previously-determined type of wood. In addition, the assembly may be sculpted for decorative purposes, according to a previously-determined style and theme. Moreover, also for aesthetically-pleasing purposes, the assembly comprises colors, graphics, and indicia thereon.

Next, the assembly further comprises a power inlet unit, which functions to receive electrical power from an existing power outlet. Such may be incorporated within either the base of the assembly or within a headboard utilized therewith. Importantly, the assembly is pre-wired for items selected from the group consisting of telephone jacks, cable jacks, high speed Internet connections, and speaker wires. Relating to same, the assembly further comprises removable back panels, functioning to allow for facilitated wiring operations.

As noted, space created by the assembly is preferably used for a computer workstation, which comprises a pull-out tray for a monitor, and sufficient space for a computer mouse, keyboard, and additional peripheral devices.

In addition, an enhanced version of the assembly further comprises an illumination means. In this mode, the illumination means comprises a remotely controlled track lighting system, providing sufficient light to the area, while maintaining an aesthetically-pleasing appearance. Thus, the assembly may utilize track lighting positioned towards the steps of the assembly, functioning to allow for enhanced safety during night hours.

It should also be noted that the assembly may further utilize a handrail for the purposes of enhanced safety. Similarly, the steps may comprise removable non-skid surfaces thereon, for the purposes of enhanced safety. Such surfaces may even be washed by the user in a convenient manner.

Generally, all components utilized are manufactured of a material that is durable, lightweight, and generally inexpensive for manufacture. In addition, the materials are intended to be relatively lightweight to reduce shipping costs and facilitate assembly.

Therefore, in total, the present invention allows for a highly functional assembly that provides for considerable comfort, efficient storage of a great variety of items, and an effective and convenient workspace—all at significantly reduced costs while maintaining a highly desirable appearance.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A loft bed assembly with multiple storage compartments comprising:

a bed frame (12), which comprises two short legs (12A) extending downwardly from a first end of the bed frame (12), and two long legs (12B) extending downwardly from a second end of the bed frame (12), functioning to raise the bed frame (12) to a substantially high plane, the bed frame (12) further comprising a mattress (14) thereon, a generally rectangular dresser component (16) removable attached to a section of steps (24), which is positioned generally perpendicular thereto, forming a generally "L" shaped configuration, a bottom surface of the dresser component (16) resting upon a floor surface (18), and a bottom portion of the section of steps (24) resting upon the floor surface (18), said dresser component (16) comprising aplurality of drawers (20), and cabinet and closet compartments (22) recessed therein, and extending outwardly from an exterior surface of said dresser component (16), said section of steps (24) comprising a plurality of drawers (20), and cabinet and closet compartments (22) recessed therein, and extending outwardly from an exterior surface of said section of steps (24), said bottom portions of said short legs (12A) of the bed frame (12) coming in contact with and resting upon an upper surface of said dresser component (16), said bottom surfaces of long legs (12B) coming in contact with and resting upon floor surface (18), a desk top surface (26) generally parallel to the floor surface (18) and extending outwardly from an interior surface of the dresser component, functioning to provide a workstation thereon.

2. The loft bed assembly with multiple storage compartments as described in claim 1, wherein the assembly is modular in nature, functioning to allow a user to easily assemble and disassemble the assembly.

3. The loft bed assembly with multiple storage compartments as described in claim 1, wherein the mattress size is selected from the group consisting of king, queen, twin, and single.

4. The loft bed assembly with multiple storage compartments as described in claim 1, wherein the assembly further includes a chair to be utilized with the desktop surface.

5. The loft bed assembly with multiple storage compartments as described in claim 1, wherein the assembly utilizes a total of four steps.

6. The loft bed assembly with multiple storage compartments as described in claim 1, wherein the assembly is of a finish selected from the group consisting of laminates and a previously-determined type of wood.

7. The loft bed assembly with multiple storage compartments as described in claim 1, wherein the assembly is sculpted for decorative purposes, according to a previously-determined style and theme.

8. The loft bed assembly with multiple storage compartments as described in claim 1, wherein the assembly comprises colors, graphics, and indicia thereon.

9. The loft bed assembly with multiple storage compartments as described in claim 1, wherein the assembly further comprises a power inlet unit, which functions to receive electrical power from an existing power outlet.

10. The loft bed assembly with multiple storage compartments as described in claim 1, wherein the assembly is pre-wired for items selected from the group consisting of telephone jacks, cable jacks, high speed Internet connections, and speaker wires.

11. The loft bed assembly with multiple storage compartments as described in claim 1, wherein the assembly further comprises removable back panels, functioning to allow for facilitated wiring operations.

* * * * *